US006637783B2

(12) United States Patent
Takamura

(10) Patent No.: US 6,637,783 B2
(45) Date of Patent: Oct. 28, 2003

(54) OPENING AND CLOSING DEVICE OF VEHICLE LOCK APPARATUS

(75) Inventor: Noboru Takamura, Kanagawa (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 10/143,879

(22) Filed: May 14, 2002

(65) Prior Publication Data

US 2002/0167179 A1 Nov. 14, 2002

(30) Foreign Application Priority Data

May 14, 2001 (JP) ..... 2001-143841
May 14, 2001 (JP) ..... 2001-143842

(51) Int. Cl.[7] ..... E05C 3/06

(52) U.S. Cl. ..... 292/201; 292/216; 292/DIG. 23; 292/DIG. 43

(58) Field of Search ..... 292/341.16, 201, 292/216, DIG. 23, DIG. 43; 49/280

(56) References Cited

U.S. PATENT DOCUMENTS 4,986,579 A * 1/1991 Ishikawa ..... 292/201
5,639,130 A * 6/1997 Rogers et al. ..... 292/216
5,876,074 A * 3/1999 Dowling ..... 292/201
5,944,367 A * 8/1999 Imaizumi et al. ..... 292/201
6,131,337 A * 10/2000 Machida ..... 49/280
6,338,508 B1 * 1/2002 Kleefeldt ..... 292/201
6,371,536 B1 * 4/2002 Koerwer et al. ..... 292/201
6,382,687 B1 * 5/2002 Gruhn ..... 292/201
6,409,233 B1 * 6/2002 Hanaki ..... 292/144
6,499,776 B2 * 12/2002 Takamura ..... 292/201
6,510,656 B1 * 1/2003 Fukumoto et al. ..... 49/280

FOREIGN PATENT DOCUMENTS

JP 5-27748 4/1993
JP 2001-182407 7/2001

* cited by examiner

*Primary Examiner*—Robert J. Sandy
*Assistant Examiner*—Dinesh Melwani
(74) *Attorney, Agent, or Firm*—Foley & Lardner

(57) ABSTRACT

In a state where a rotary member has stopped at a position other than a neutral position, an actuating lever can be returned to the neutral position by an urging device, and retained in the neutral position, by shifting a switching member from a connecting state to a disconnecting state. When the rotary member which has been at the position other than the neutral position is returned to the neutral position, the switching member staying in the disconnecting state is shifted to the connecting state to establish a coupling between the rotary member and the actuating lever.

9 Claims, 10 Drawing Sheets

OPENING AND CLOSING DEVICE OF VEHICLE LOCK APPARATUS

CROSS REFERENCE TO RELATED APPLICATIONS

The present application is based on Japanese Patent Applications No. 2001-143841 and 2001-143842, the entire contents of which are incorporated herein by reference.

BACKGROUND OF THE INVENTION

1. Field of the Invention

The present invention relates to an opening and closing device of a vehicle lock apparatus which is provided with a closing function for forcibly shifting a lock device from a half latched state to a fully latched state, and an opening function for actuating the lock device to be opened.

2. Related Art

There has been known a device of the type as described above which includes a latch capable of being engaged or disengaged with a striker, a lock device provided with a locking plate capable of being engaged or disengaged with the latch, and an actuating device having a rotary member which can be rotated by a motor from a neutral position in two opposite directions, normal and reverse, wherein the latch is adapted to be disengaged from the striker with a rotation of the rotary member from the neutral position in one direction, and the latch is adapted to be shifted from a half latched state to a fully latched state with a rotation of the rotary member in the other direction (Refer to Japanese Patent Publication No. JP-B-5-27748, for example).

However, in the conventional device as described above, there has been such a problem that when the rotation of the motor has stopped during operation of the actuating device due to a trouble in an electrical system or some other reason, and the rotary member has stopped at a position other than the neutral position, the latch and the locking plate which have been moved by the rotary member will be restrained from moving, making the lock device inoperable, and so, it will be impossible to open or close a vehicle door or the like.

On the other hand, in Japanese Patent Publication No. JP-A-2001-182407, the problem in the above has been solved. In the opening and closing device, even though the rotary member has stopped in a position other than the neutral position, a switching member interconnecting the rotary member and the actuating lever is shifted from a connecting state to a disconnecting state by operating a canceling lever, thereby disconnecting the coupling between the rotary member and the actuating lever, thus enabling the actuating lever to be returned to the neutral position.

However, the above opening and closing device has had such a problem that when the rotary member which has stopped at the position other than the neutral position is rotated to the neutral position, the actuating lever disconnected from the coupling with the rotary member and staying in the neutral position may be drawn by the rotation of the rotary member to be displaced from the neutral position. If this has happened, movement of the switching member from the disconnecting state to the connecting state would be difficult, and it would be necessary to reconnect the rotary member and the actuating lever which have been disconnected from each other, requiring troublesome works.

Further, the above opening and closing device has had such an anxiety that because the switching member is slidably engaged in an elongated hole in the canceling lever, when the switching member is moved to the disconnecting state by operating the canceling lever, the canceling lever may be restrained in the canceling position together with the switching member. If this has happened, it would be difficult to return the canceling lever to the waiting position, which incurs deterioration in quality.

SUMMARY OF THE INVENTION

In view of the problems that the related art has had as described above, it is an object of the present invention to provide an opening and closing device of a vehicle lock apparatus in which a lock device can be operated, even though a rotary member has stopped at a position other than a neutral position, and at the same time, coupling between the rotary member and an actuating lever is ensured in order to enhance quality of the product. Further, The present invention provides an opening and closing device of a vehicle lock apparatus in which during canceling operation, return of the canceling lever to the waiting position is made possible, and quality of the product can be enhanced.

According to the present invention, the above described problems will be solved in the following manner;

(1) An opening and closing device of a vehicle lock apparatus comprising:

a lock device actuated by a motor to be opened, and to be shifted from a half latched state to a fully latched state;

a rotary member rotatable from a neutral position in two of a normal direction and reverse direction by the motor;

an actuating lever linked to the rotary member, the actuating lever rotatable from a neutral position in an opening direction thereby to open the lock device, and being rotated in a closing direction opposite to the opening direction thereby to shift the lock device from the half latched state to the fully latched state;

an opening lever rotatable from a waiting position to an operating position by a rotation of the actuating lever in the opening direction thereby to open the lock device;

a switching member for connecting the rotary member and the actuating lever; and an urging device for urging the actuating lever to the neutral position independently of the rotary member;

wherein the switching member is configured to be shifted between a disconnecting state where the switching member disconnects a coupling between the rotary member and the actuating lever so that the actuating lever is rotated to the neutral position of the rotary member from a stopping position of the rotary member which is not the neutral position of the rotary member, and a connecting state where the rotary member in the stop position is rotated to the neutral position of the rotary member and the switching member is retained to the actuating member which is in the neutral position of the actuating member thereby to establish the coupling between the rotary member and the actuating lever.

(2) An opening and closing device of a vehicle lock apparatus according to the above item (1), the urging device including a helical coil spring provided with a first leg portion and a second leg portion, wherein when the actuating lever is rotated in the opening direction from the neutral position, the first leg portion of the helical coil spring is engaged with the actuating lever, while the second leg portion is engaged with a base plate on which the opening lever is pivotally mounted, thereby urging the actuating lever to the neutral position thereof, and when the actuating lever is rotated in the closing direction from the neutral position, the second leg portion of the helical coil spring is engaged with the actuating lever, while the first leg portion is engaged with the opening lever, thereby to respectively urge the actuating lever to the neutral position thereof, and the opening lever to the waiting position.

(3) An opening and closing device of a vehicle lock apparatus comprising:

a lock device actuated by a motor to be opened, and to be shifted from a half latched state to a fully latched state;

a rotary member rotatable from a neutral position in two of a normal direction and reverse direction by the motor;

an actuating lever linked to the rotary member, the actuating lever rotatable from a neutral position in an opening direction thereby to open the lock device, and being rotated in a closing direction opposite to the opening direction thereby to shift the lock device from the half latched state to the fully latched state;

a switching member movable in a connecting state where the rotary member and the actuating lever are coupled through the switching member and a disconnecting state where the switching member disconnects a coupling between the rotary member and an actuating lever;

an urging device for urging the switching member from the disconnecting state to the connecting state; and a canceling lever having a canceling arm portion adapted to be abutted against the switching member;

wherein the switching member is shifted from the connecting state to the disconnecting state by a rotation of the canceling lever from a waiting position to a canceling position, and the switching member is moved apart from the switching member by a rotation of the canceling lever from the canceling position to the waiting position.

(4) An opening and closing device of a vehicle lock apparatus comprising:

a lock device actuated by a motor to be opened, and to be shifted from a half latched state to a fully latched state;

a rotary member rotatable from a neutral position in two of a normal direction and reverse direction by the motor;

an actuating lever linked to the rotary member, the actuating lever rotatable from a neutral position in an opening direction thereby to open the lock device, and being rotated in a closing direction opposite to the opening direction thereby to shift the lock device from the half latched state to the fully latched state;

a switching member movable in a connecting state where the rotary member and the actuating lever are coupled through the switching member and a disconnecting state where the switching member disconnects a coupling between the rotary member and an actuating lever;

an urging device for urging the switching member from the disconnecting state to the connecting state;

a canceling lever having a canceling arm portion adapted to be abutted against the switching member; and a guide device for guiding the canceling arm portion so as to move along a moving direction of the switching member, and so as not to move in a direction intersecting the moving direction;

wherein the switching member is shifted from the connecting state to the disconnecting state by a rotation of the canceling lever from a waiting position to a canceling position, and the switching member is moved apart from the switching member by a rotation of the canceling lever from the canceling position to the waiting position.

(5) An opening and closing device of a vehicle lock apparatus according to (4), wherein the guide device are provided in the actuating lever.

(6) An opening and closing device of a vehicle lock apparatus according to (4) or (5), wherein the guide device includes a support portion which is brought into a slidable contact with one side face of the canceling arm portion to support the switching member movably, and a pressing portion provided adjacent to the support portion and brought into a slidable contact with another side face of the canceling arm portion.

(7) An opening and closing device of a vehicle lock apparatus according to (1) through (6), further comprising:

a switching hole formed on the rotary member, the switching hole having an arc-shaped idle portion laterally extending around a shaft pivotally supporting the rotary member, and a retaining portion radially extending from a substantially middle of the idle portion; and an elongated hole formed on the actuating lever so as to be overlapped on the switching hole;

wherein the rotary member and the actuating lever are pivotally mounted on a common shaft and the switching member is slidably engaged in the switching hole and the elongated hole; and wherein the switching member is retained at the retaining portion when the switching member is in the connecting state, and the switching member is released from the retaining portion and slidably positioned in the idle portion when the switching member is in the disconnecting state.

DETAILED DESCRIPTION OF THE PREFERRED EMBODIMENTS

Figure 1:
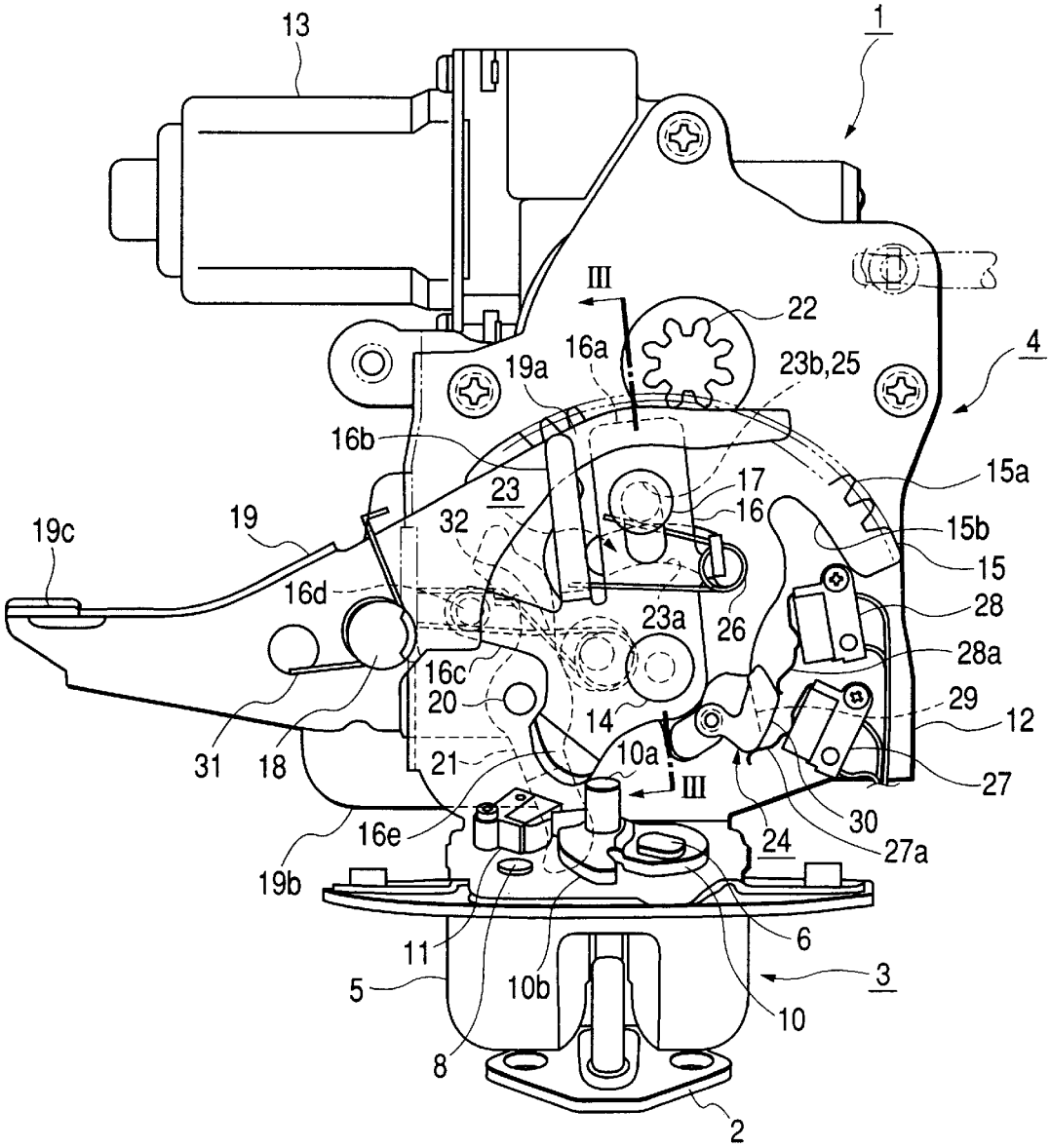
FIG. 1 is a front view of an opening and closing device of a vehicle lock apparatus in an embodiment according to the present invention.

Now, an embodiment of the present invention will be described referring to the drawings. It is to be noted that in the following description, a front side in FIG. 1 is referred to as "forward direction" and a back side in FIG. 1 is referred to as "backward direction" of a vehicle.

Numeral (1) designates an opening and closing device to be mounted on a back door (not shown) whose upper end is pivotally fitted to a rear part of a vehicle body by means of a laterally directed hinge shaft (not shown) so as to be opened and closed in a vertical direction. The opening and closing device includes a lock device (3) which is adapted to be engaged with a striker (2) fixed to the vehicle body for keeping the back door in a closed position, and an actuating device (4) provided with closing function for actuating the lock device (3) from a half latched state to a fully latched state, as well as opening function for actuating the lock device (3) to be opened.

Figure 14:
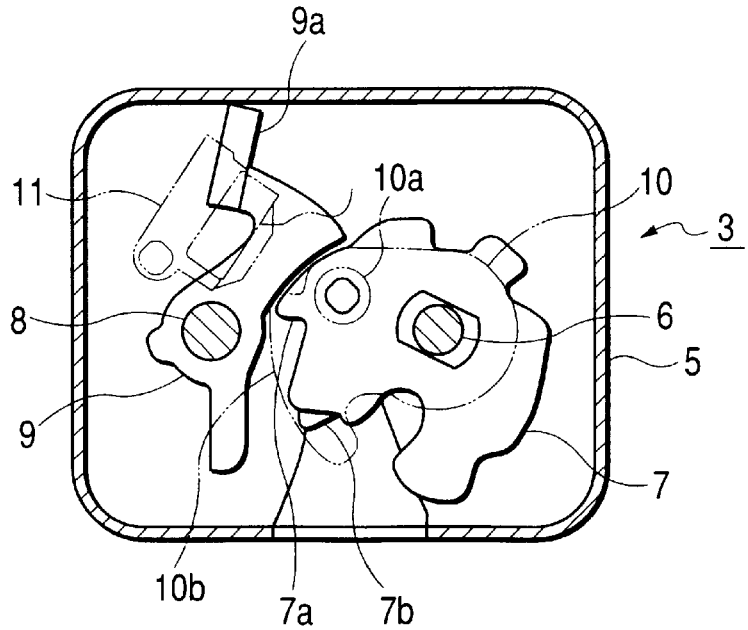
FIG. 14 is a plan view of a lock device in the opening and closing device in an open state.
Figure 15:
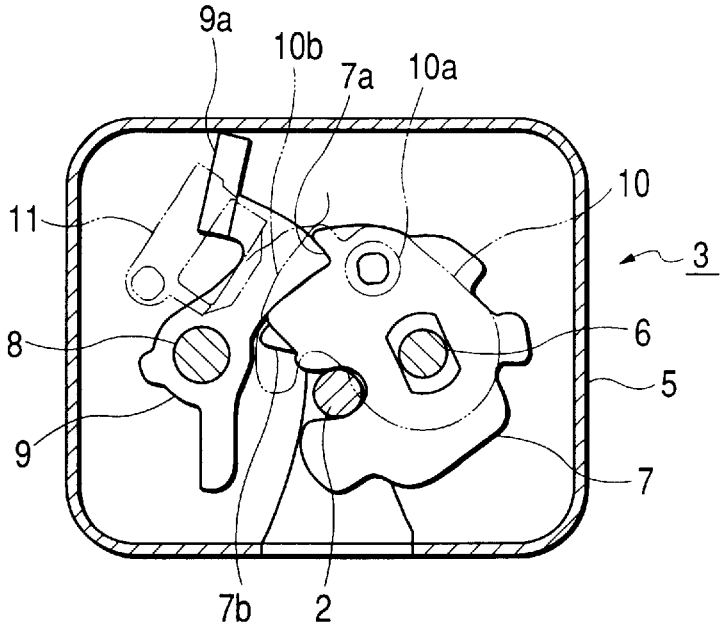
FIG. 15 is a plan view of the lock device in the opening and closing device in a half latched state.
Figure 16:
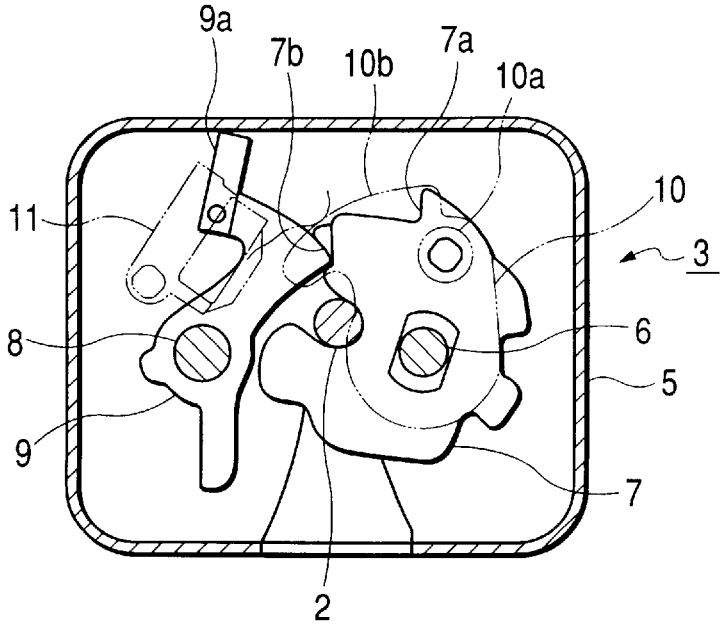
FIG. 16 is a plan view of the lock device in the opening and closing device in a fully latched state.

As shown in FIGS. 14 to 16, the lock device (3) includes a housing (5), a latch (7) which is pivotally fitted in the housing (5) by means of a vertically directed shaft (6) and capable of being engaged and disengaged with the striker (2), and a locking plate (9) which is pivotally fitted by means of a shaft (8) similar to the shaft (6) and adapted to be engaged with claws (7*a*), (7*b*) of the latch (7).

The latch (7) is movable among an open position as shown in FIG. 14 in which the latch is disengaged from the striker (2), a half latched position as shown in FIG. 15 in which the latch is barely engaged with the striker (2), and a fully latched position as shown in FIG. 16 in which the latch (7) is completely engaged with the striker (2).

The locking plate (9) is urged in an engaging direction (a clockwise direction in FIGS. 14 to 16) by means of a spring (not shown), and adapted to be respectively engaged with the claw (7*a*) of the latch (7) when the latch (7) is in the half latched position and with the claw (7*b*) when the latch (7) is in the fully latched position. In both the positions, rotation of the latch (7) into the open position (a counterclockwise direction in FIGS. 14 to 16) will be restrained.

A cam lever (10) which is rotatable integrally with the latch (7) is fixed to an upper end of the shaft (6). To a free end of this cam lever (10), is fixed an upwardly directed engaging pin (10*a*), and a cam portion (10*b*) is provided on an outer peripheral edge of the cam lever (10).

Numeral (11) designates a detection switch provided on a horizontal area of a base plate (12) which is fixed to an upper part of the housing (5). When the detection switch (11) comes into contact with the cam portion (10*b*) of the cam lever (10), the half latched position of the latch (7) is detected.

Figure 2:
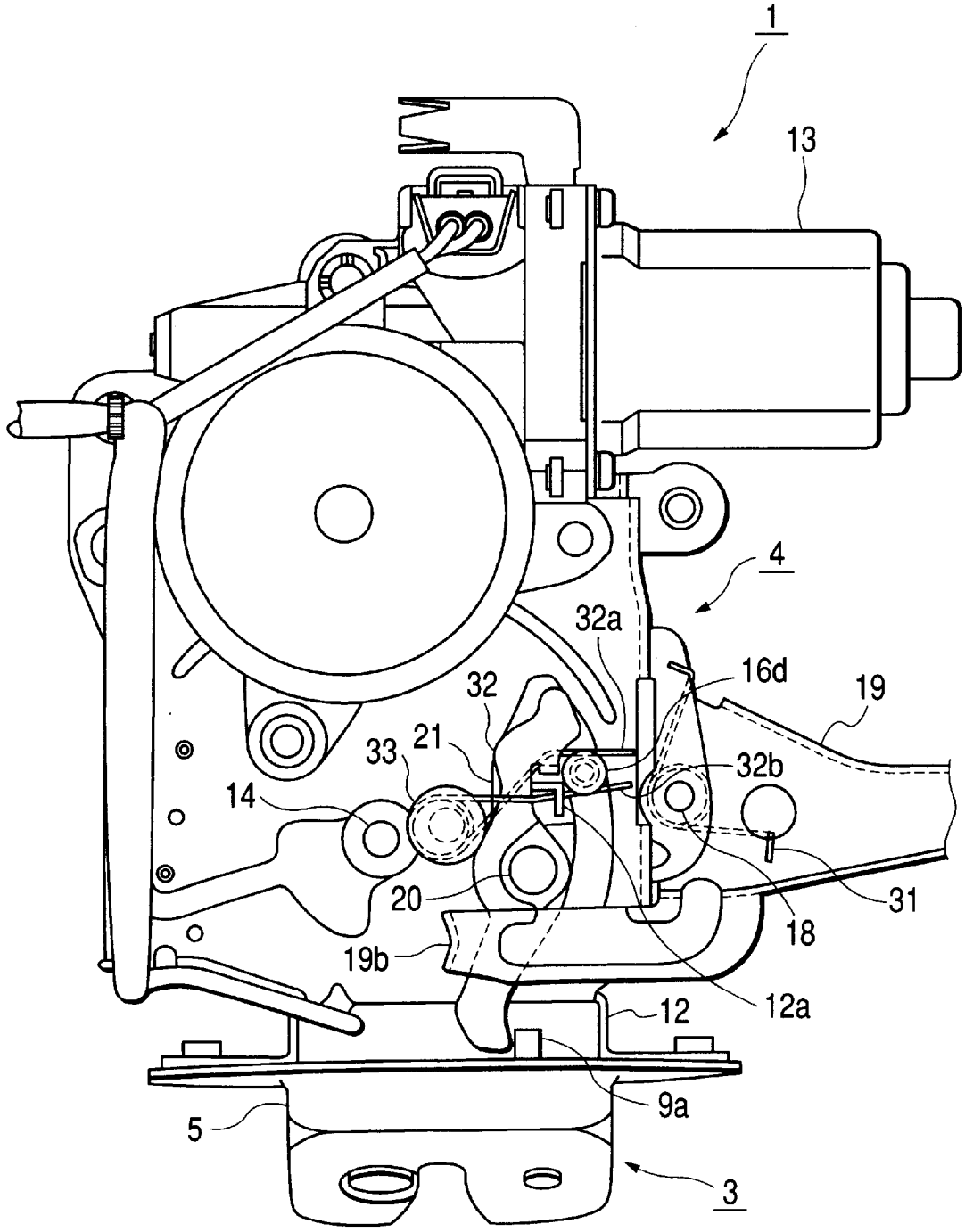
FIG. 2 is a rear view of the opening and closing device of the vehicle lock apparatus.

As shown in FIG. 1, the actuating device (4) includes a motor (13) mounted on an upper part of the base plate (12), a sector gear (15) acting as a rotary member which is pivotally mounted on a substantially center part of a front face of the base plate (12) by means of a pivotal shaft (14) which is directed in a back and forth direction, an actuating lever (16) pivotally mounted on the same pivotal shaft (14) as the sector gear (15) in a similar manner, a switching member (17) provided between the sector gear (15) and the actuating lever (16), a canceling lever (19) pivotally mounted on the base plate (12) by means of a shaft (18) which is directed in a back and forth direction, and an opening lever (21) pivotally mounted on a back face of the base plate (12) by means of a shaft (20) which is directed in a back and forth direction, as shown in FIG. 2.

The motor (13) is so adapted as to be controlled in a normal direction by operating a handle switch (not shown) which is provided on an outer panel of the back door, and so adapted as to be controlled in a reverse direction when the detection switch (11) has detected the half latched position.

Figure 5:
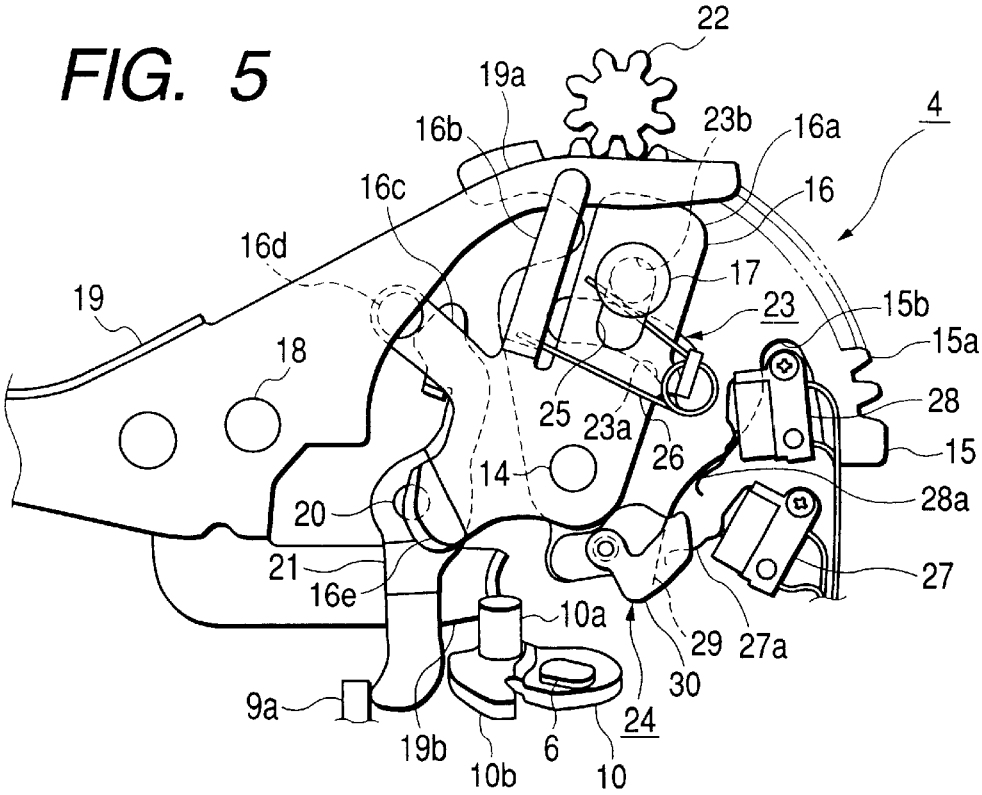
FIG. 5 is a schematic front view of an essential part of the opening and closing device when the rotary member and an actuating lever are in an open position.
Figure 6:
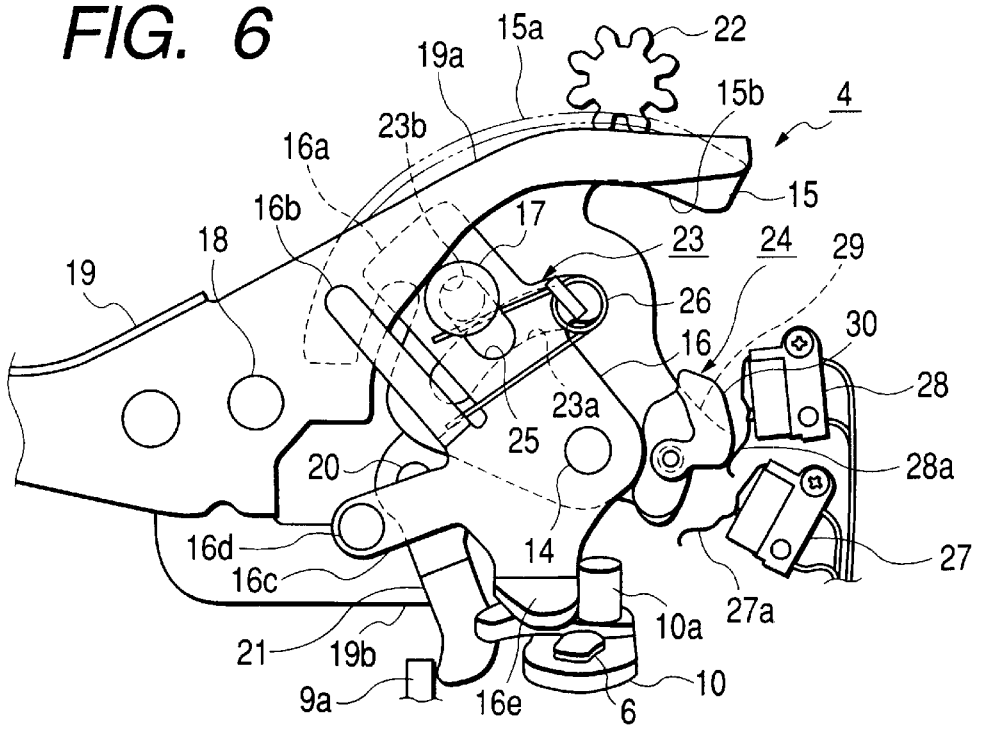
FIG. 6 is a schematic front view of the essential part of the opening and closing device when the rotary member and the actuating lever are in a closed position.
Figure 9:
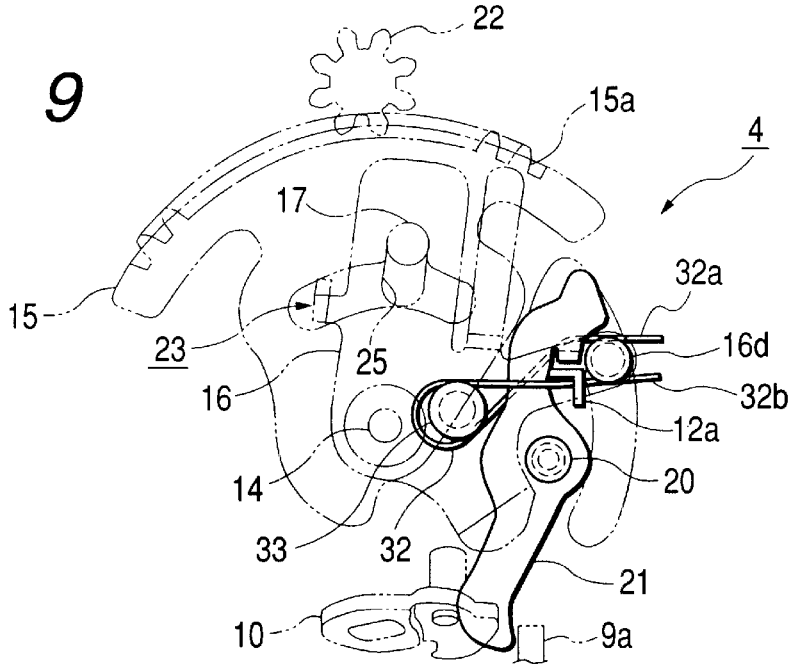
FIG. 9 is a schematic rear view of the essential part of the opening and closing device when the rotary member and the actuating lever are in a neutral position.
Figure 10:
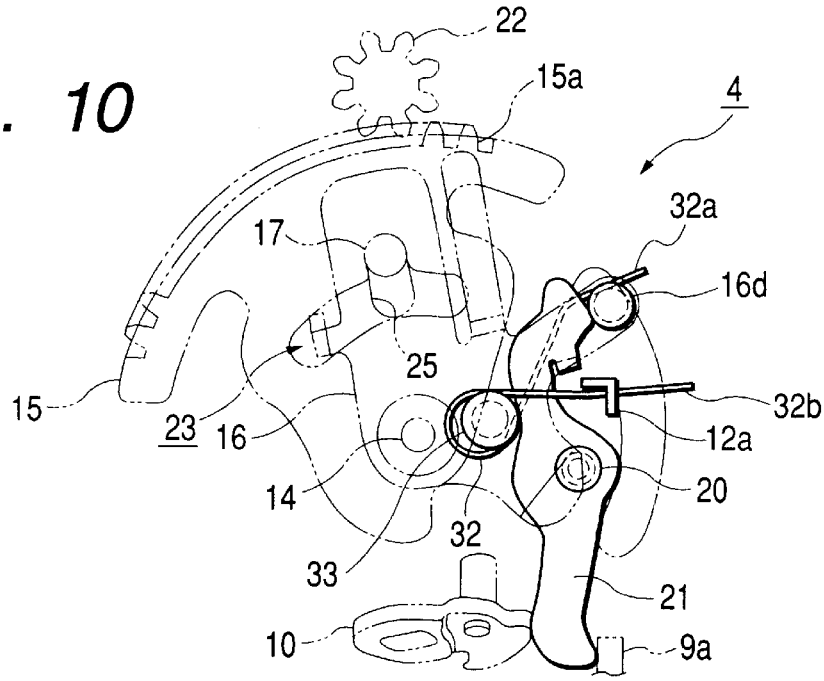
FIG. 10 is a schematic rear view of the essential part of the opening and closing device when the rotary member and the actuating lever are in the open position.
Figure 11:
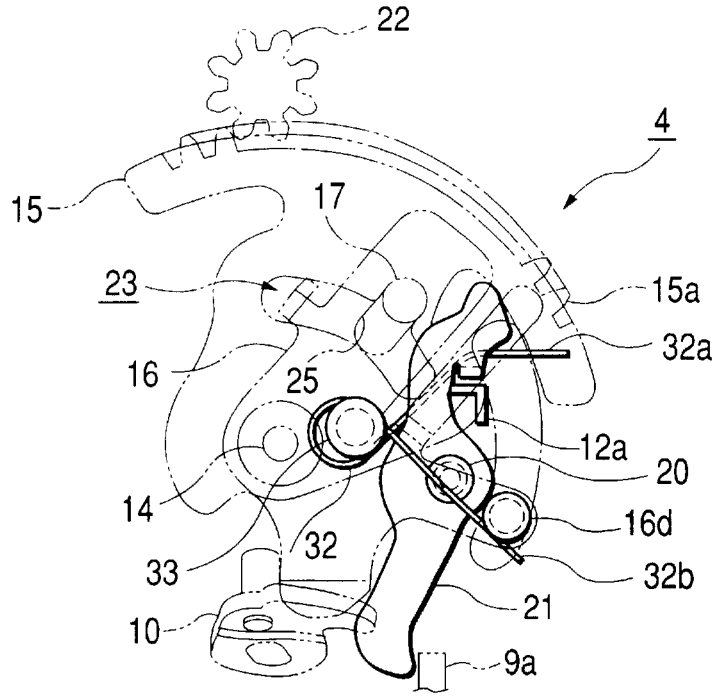
FIG. 11 is a schematic rear view of the essential part of the opening and closing device when the rotary member and the actuating lever are in the closed position.

Teeth (15*a*) formed at an outer circumferential edge of the sector gear (15) are meshed with an output gear (22) of a reduction mechanism for decelerating rotating force of the motor (13), and the sector gear (15) is so adapted to be rotated by the motor (13) from a neutral position as shown in FIGS. 1 and 9, to an open position as shown in FIGS. 5 and 10, and to a closed position as shown in FIGS. 6 and 11.

Figure 4:
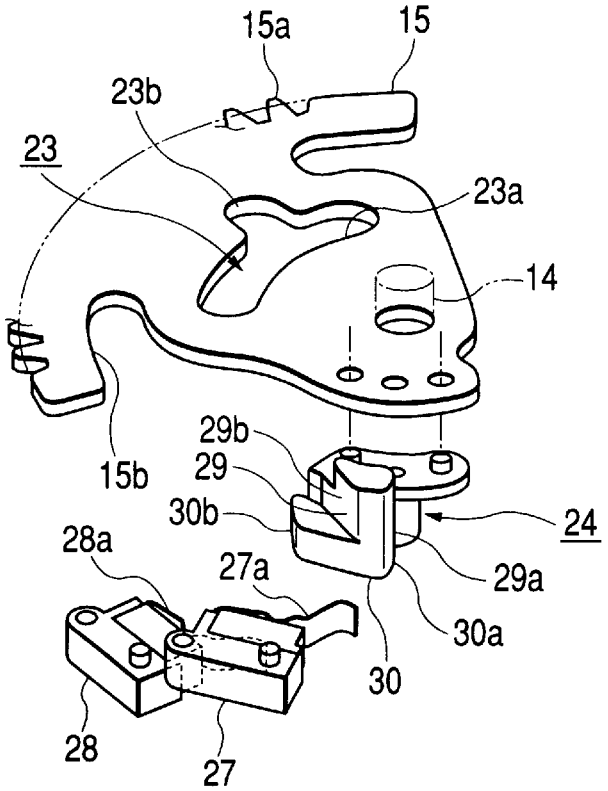
FIG. 4 is an exploded perspective view of a rotary member and a cam member in the opening and closing device.

There is formed in an upper part of the sector gear (15), as mainly shown in FIG. 4, a switching hole (23) in an inverted T-shape which has an arc-shaped idle portion (23*a*) laterally extending around the pivotal shaft (14), and a retaining portion (23*b*) radially extending from a substantially middle of the idle portion (23*a*). In addition, a cam member (24) is fixed to the sector gear (15) near the pivotal shaft (14). There are formed relief portions (15*b*) extending in a shape of arc around the pivotal shaft (14), between the teeth (15*a*) of the sector gear (15) and the cam member (24).

The actuating lever (16) can be rotated in the same manner as the sector gear (15), from a neutral position as shown in FIGS. 1 and 9, to an open position as shown in FIGS. 5 and 10, and to a closed position as shown in FIGS. 6 and 11 together with the sector gear (15). The actuating lever (16) is provided with a support portion (16*a*) and a pressing portion (16*b*) which serve as a guide device.

The support portion (16*a*) extends upwardly, and there is formed, in its center part, a vertically elongated hole (25) which is overlapped on the switching hole (23) in the sector gear (15).

The pressing portion (16*b*) is offset forward by a predetermined amount from a front face of the support portion (16*a*), and provided on a left side (near the shaft (18)) of the support portion (16*a*).

An open arm portion (16*c*) to which a locking pin (16*d*) is fixed, and a close arm portion (16*e*) are provided respectively on a left side and a lower part of the actuating lever (16).

The locking pin (16*d*) of the open arm portion (16*c*) is adapted to be abutted against an upper part of the opening lever (21) so as to rotate the opening lever (21) to an open position according to the rotation of the actuating lever (16) to the open position as shown in FIGS. 5 and 10.

The close arm portion (16*e*) is adapted to be abutted against the engaging pin (10*a*) of the cam lever (10) according to the rotation of the actuating lever (16) to the closed position as shown in FIGS. 6 and 11, allowing the latch (7) to rotate from the half latched position to the fully latched position by way of the cam lever (10).

Figure 3:
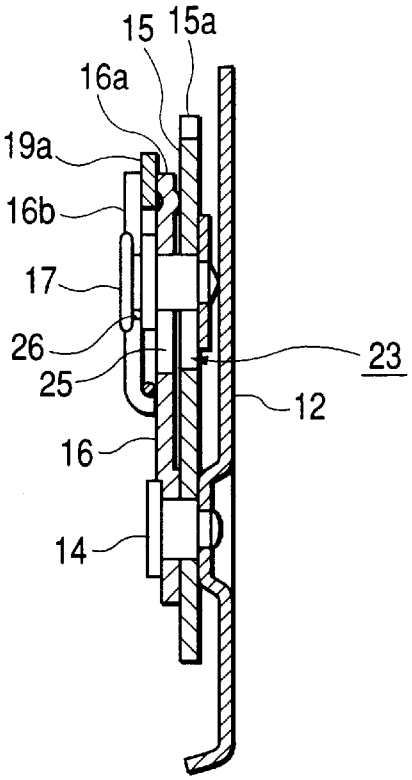
FIG. 3 is an enlarged view in a vertical section taken along a line III—III in FIG. 1.

The switching member (17) is, as shown mainly in FIG. 3, in a form of a flanged shaft extending in a back and forth direction, and slidably engaged in the switching hole (23) of the sector gear (15) and the elongated hole (25) in the actuating lever (16). The switching member (17) is movable between a connecting state in which the switching member (17) is engaged with the retaining portion (23*b*) of the switching hole (23) to establish a coupling between the sector gear (15) and the actuating lever (16) enabling them to integrally rotate as shown mainly in FIG. 1, and a disconnecting state in which the switching member (17) enters in the idle portion (23*a*) to disconnect the coupling between the sector gear (15) and the actuating lever (16) as shown mainly in FIGS. 7 and 8.

Numeral (26) designates a spring supported by the actuating lever (16) for urging the switching member (17) from the disconnecting state to the connecting state.

Numeral (27) designates a first detection switch for detecting the open position of the sector gear (15), and is adapted to be switched from on to off, when its actuator (27*a*) of a hinge type is abutted against a first cam face (29) formed on the cam member (24).

Numeral (28) designates a second detection switch for detecting the closed position of the sector gear (15), and is adapted to be switched from on to off, when its actuator (28*a*) of a hinge type is abutted against a second cam face (30) formed on the cam member (24).

The first and the second detection switches (27), (28) are arranged on the base plate (12) with their respective actuators (27*a*), (28*a*) directed in a same direction, in such a manner that they can move relatively in the relief portions (15*b*) of the sector gear (15).

The second detection switch (28) is supported by a support table (not shown) fixed to the base plate (12) and offset forward with respect to the first detection switch (27).

The cam member (24) has, as shown mainly in FIG. 4, the first cam face (29) which can be abutted against the actuator (27*a*) of the first detection switch (27) and the second cam face (30) which is provided forward of the first cam face (29) and can be abutted against the actuator (28*a*) of the second detection switch (28). The lower side in FIG. 4 corresponds to a forward direction of the vehicle, while the upper side in FIG. 4 corresponds to a backward direction of the vehicle.

Figure 17:
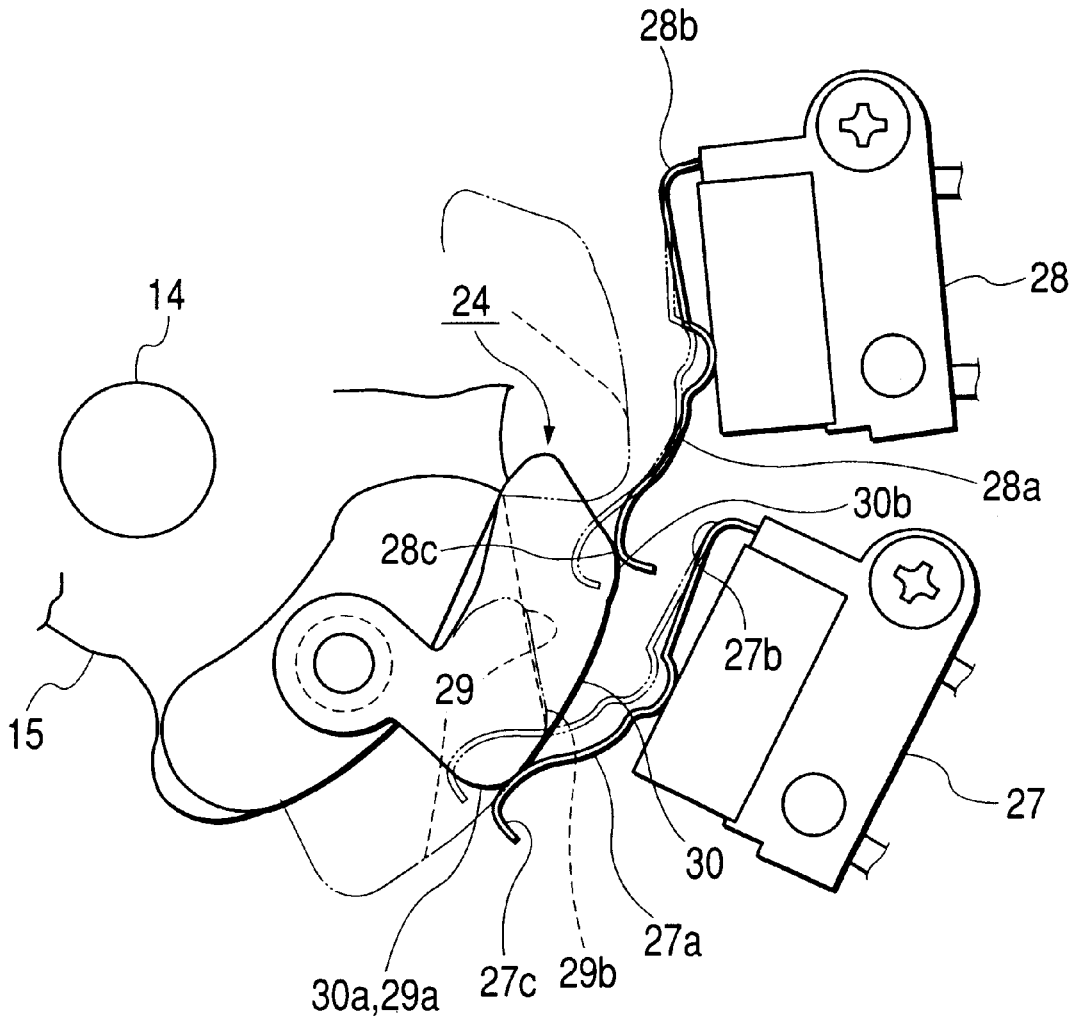
FIG. 17 is an enlarged front view of the essential part of the opening and closing device.

As shown in FIG. 17, there are formed, at respective one ends of the first and the second cam faces (29), (30), acute angle portions (29*a*), (30*a*) which come into contact with the actuators (27*a*), (28*a*) of the first and the second detection switches (27), (28) from their hinge portions (27*b*), (28*b*) to minimize variation in detecting positions, and at the respective other ends, obtuse angle portions (29*b*), (30*b*) which come into contact with the actuators (27*a*), (28*a*) from their free end portions (27*c*), (28*c*) for enabling the cam faces (29), (30) to be smoothly contacted with the actuators (27*a*), (28*a*)

In the open position of the sector gear (15), the first cam face (29) is moved apart from the actuator (27*a*) of the first detection switch (27) as shown in FIG. 5, to switch the first detection switch (27) from off to on, thereby controlling the motor (13) in the reverse direction so as to return the sector gear (15) to the neutral position.

In the closed position of the sector gear (15), the second cam face (30) is moved apart from the actuator (28*a*) of the second detection switch (28) as shown in FIG. 6, to switch the second detection switch (28) from off to on, thereby controlling the motor (13) in the reverse direction so as to return the sector gear (15) to the neutral position.

In case where the sector gear (15) is rotated from the closed position to the neutral position, the second cam face (30) comes into contact with the actuator (28*a*) of the second detection switch (28) from the acute angle portion (30*a*), to switch the second detection switch (28) from on to off. Maintaining this state, the first cam face (29) comes into contact with the actuator (27*a*) of the first detection switch (27) from the acute angle portion (29*a*), to switch the first detection switch (27) from on to off. The neutral position of the sector gear (15) can be detected in this manner.

Because the neutral position of the sector gear (15) can be detected at a point of time when the acute angle portion (29*a*) of the first cam face (29) has come into contact with the actuator (27*a*) of the first detection switch (27), in this case, it is possible to stop the sector gear (15) in the neutral position reliably, depressing the variation in the detecting positions to the least.

Figure 7:
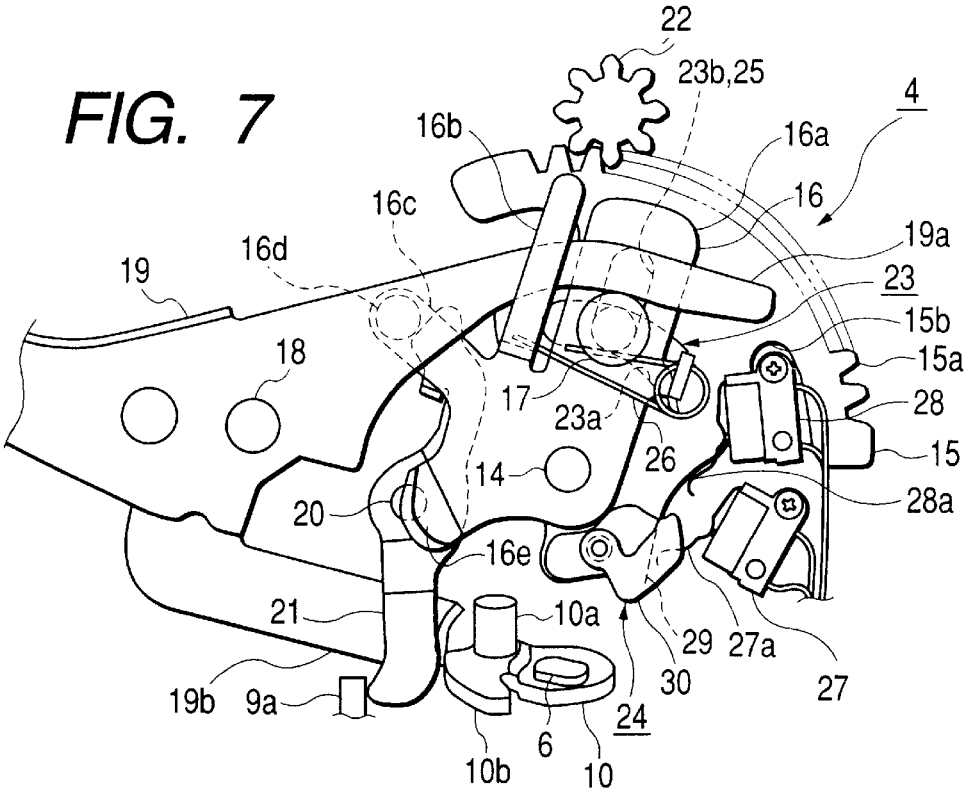
FIG. 7 is a schematic front view of the essential part of the opening and closing device in a state where an opening action has been cancelled.
Figure 8:
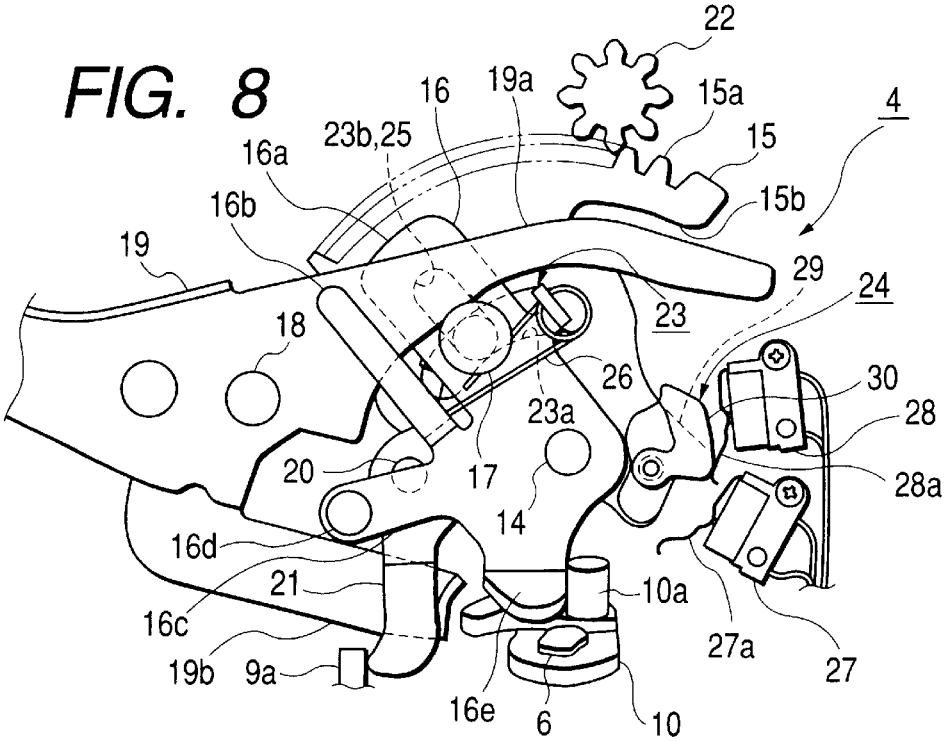
FIG. 8 is a schematic front view of the essential part of the opening and closing device in a state where a closing action has been cancelled.

The canceling lever (19) has a canceling arm portion (19*a*) which is movable between a waiting position as shown in FIG. 1 and a canceling position as shown in FIGS. 7 and 8, and which is urged to the waiting position by means of a spring (31), and extends so as to intersect the support portion (16*a*) and the pressing portion (16*b*) of the actuating lever (16), an opening arm portion (19*b*) which can be abutted against a lower part of the opening lever (21), and an operating portion (19*c*).

The canceling arm portion (19*a*) is guided so as to move along a moving direction of the switching member (17) in such a manner that a shakiness between the support portion (16*a*) and the pressing portion (16*b*) in a direction of its thickness (a back and forth direction) may be prevented, and so as to be abutted against the switching member (17) only from a direction in which the switching member (17) is moved from the connecting state to the disconnecting state.

Irrespective of the position of the actuating lever (16), the canceling arm portion (19*a*) can shift the switching member (17) from the connecting state to the disconnecting state. The canceling arm portion (19*a*) has such a length that it can be guided by the support portion (16*a*) and the pressing portion (16*b*), irrespective of the positions of the canceling arm portion itself and the actuating lever (16).

Although the pressing portion (16*b*) serving as a guide device is provided on the actuating lever (16) in this embodiment, it may be provided on the base plate (12) alternatively.

When the canceling lever (19) is rotated in the canceling direction from the waiting position, the opening arm portion (19*b*) of the canceling lever (19) comes into contact with the lower part of the opening lever (21) to rotate the opening lever (21) in an opening direction.

The operating portion (19*c*) of the canceling lever (19) is mounted on such a position that it can be operated from the outside by removing a part of a trim on an inner panel of the back door.

As shown in FIG. 2, when the opening lever (21) has been rotated in the opening direction (in a counterclockwise direction in FIG. 2) from the waiting position in which it has been in contact with the lock portion (12*a*) provided on the base plate (12), the lower part of the opening lever (21) comes into contact with an extended portion (9*a*) of the locking plate (9) thereby to rotate the locking plate (9) in an opening direction.

A helical coil spring (32) which is held on a support shaft (33) fixed to the base plate (12) urges the opening lever (21) to the waiting position and the actuating lever (16) to the neutral position respectively.

Specifically, when the actuating lever (16) is in the open position, one leg portion (32*a*) of the helical coil spring (32) is engaged with the locking pin (16*d*) of the actuating lever (16), and the other leg portion (32*b*) is engaged with the lock portion (12*a*) respectively as shown in FIG. 10, thereby to urge the actuating lever (16) from the open position to the neutral position.

Moreover, when the actuating lever (16) is in the closed position, the other leg portion (32*b*) of the helical coil spring (32) is engaged with the locking pin (16*d*) of the actuating lever (16), and the one leg portion (32*a*) is engaged with the opening lever (21) respectively as shown in FIG. 11, thereby to urge the actuating lever (16) from the closed position to the neutral position, and the opening lever (21) to the waiting position respectively.

In this manner, the actuating lever (16) and the opening lever (21) can be urged in predetermined directions by the single helical coil spring (32), and therefore, number of components will be decreased, and the structure can be simplified.

Then, various functions of the above described embodiment will be described.

(Opening Function)

When the back door is in the closed state, the sector gear (15) and the actuating lever (16) of the actuating device (4) are connected by the switching member (17) in the neutral position, as shown in FIG. 1 and FIG. 9. In the lock device (3), the latch (7) is in the fully latched position as shown in FIG. 16, and the locking plate (9) is engaged with the claw (7*b*) of the latch (7).

When a handle switch of the back door is operated in this state, the motor (13) starts to normally rotate. The sector gear (15) and the actuating lever (16) are urged to rotate from the neutral position to the open position as shown in FIG. 5 and FIG. 10, resisting urging force of the helical coil spring (32). This will make the locking plate (9) rotate in the opening direction by way of the locking pin (16*d*) and the opening lever (21) to disengage the latch (7) from the striker (2). The back door can be opened in this manner.

When the sector gear (15) is rotated to the open position and the obtuse angle portion (29*b*) of the first cam face (29) is moved apart from the actuator (27*a*) of the first detection switch (27), the open position of the sector gear (15) will be detected, and the motor (13) will be controlled to start a reverse rotation.

The sector gear (15) and the actuating lever (16) are rotated by the motor (13) from the open position to the neutral position, and when the first and the second cam faces (29), (30) have come into contact with the actuators (27*a*), (28*a*) of the first and the second detection switches (27), (28) from their obtuse angle portions (29*b*), (30*b*), the neutral position of the sector gear (15) will be detected. This will make the sector gear (15) and the actuating lever (16) stop in their neutral positions.

(Closing Function)

By closing the back door which has been in the open state, the latch (7) will be engaged with the striker (2) and rotated from the open position as shown in FIG. 14 to the half latched position as shown in FIG. 15.

When the detection switch (11) has detected the half latched position of the latch (7) via the cam lever (10), the motor (13) will be controlled to make the reverse rotation, and the sector gear (15) and the actuating lever (16) will be rotated to the closed position as shown in FIG. 6 and FIG. 11.

According to the rotation of the actuating lever (16), the latch (7) is urged to rotate from the half latched position to the fully latched position by way of the close arm portion (16*e*) and the cam lever (10), and the back door will be shifted from the half locked state to the fully closed position.

When the second cam face (30) is moved apart from the actuator (28*a*) of the second detection switch (28) along with the rotation of the sector gear (15) as shown in FIG. 6, the closed position of the sector gear (15) will be detected and the motor (13) will be controlled to make the normal rotation.

When the sector gear (15) and the actuating lever (16) have been rotated by the motor (13) to the neutral position, and the first and the second cam faces (29), (30) have come into contact with the actuators (27*a*), (28*a*) of the first and the second detection switches (27), (28) from their acute angle portions (29*a*), (30*a*), the neutral position of the sector gear (15) will be detected. This will reliably make the sector gear (15) and the actuating lever (16) stop in their neutral positions.

On this occasion, since the opening lever (21) has been held in the waiting position by means of the helical coil spring (32), interference of the lower part of the opening lever (21) with the extended portion (9*a*) of the locking plate (9) can be prevented, and thus, reliable operation can be obtained.

(Canceling Function)

In case where during the opening operation, the sector gear (15) and the actuating lever (16) have stopped in the open position or near the open position due to a trouble, for example, in the motor (13) or in the control circuit, the rotation of the locking plate (9) in the engaging direction will be blocked by the opening lever (21) which has been moved in the open position, As the results, it will become impossible to close the back door which has been once opened.

In such cases, by rotating the canceling lever (19) from the waiting position to the canceling position against urging force of the spring (31), and by shifting the switching member (17) from the connecting state to the disconnecting state by the canceling arm portion (19*a*) against urging force of the spring (26), the coupling between the sector gear (15) and the actuating lever (16) will be disconnected.

Figure 12:
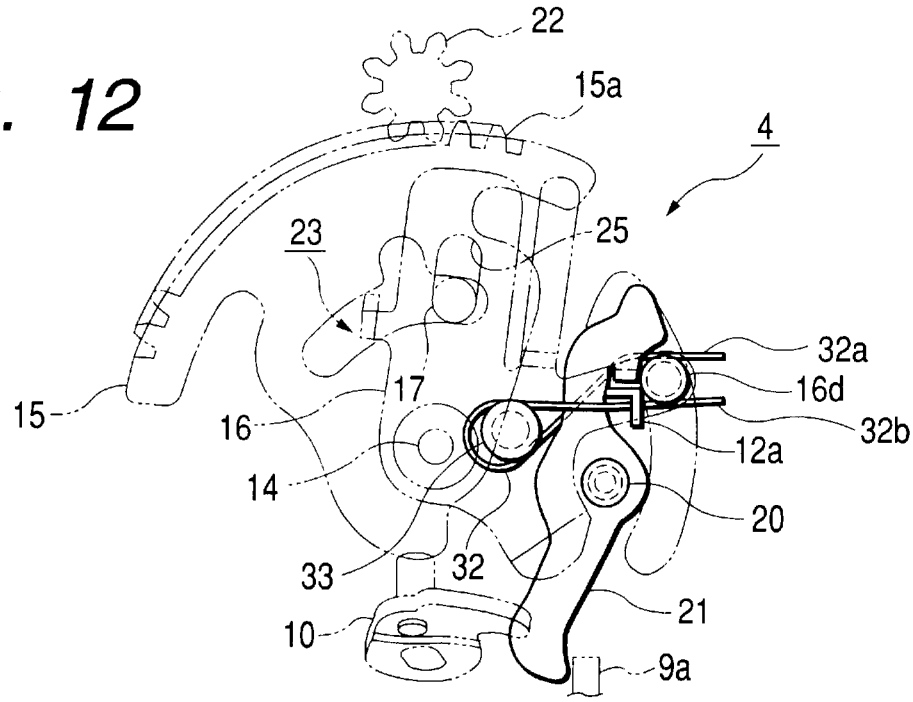
FIG. 12 is a schematic rear view of the essential part of the opening and closing device in a state where the opening action has been cancelled and the actuating lever has been returned to the neutral position.

This will rotate the actuating lever (16) to the neutral position by the urging force of the helical coil spring (32), as shown in FIG. 12, to release the restraint of the locking plate (9), and the back door will be able to be closed. On this occasion, the switching member (17) moves toward one end of the idle portion (23*a*) and held in the disconnecting state.

The canceling lever (19) will be returned from the canceling position to the waiting position by the urging force of the spring (31), and the canceling arm portion (19*a*) will be moved apart from the switching member (17) which is in the disconnecting state.

When the sector gear (15) and the actuating lever (16) have stopped, during the closing operation, in the closed position or near the closed position for the same reason as described above, the rotation of the latch (7) in the opening direction will be blocked as shown in FIG. 6 and FIG. 11. As the results, it will become impossible to open the back door which has been once closed.

In this case too, similarly to the above, by rotating the canceling lever (19) to the canceling position as shown in FIG. 8, to move the switching member (17) from the connecting state to the disconnecting state, the coupling between the sector gear (15) and the actuating lever (16) can be disconnected.

Figure 13:
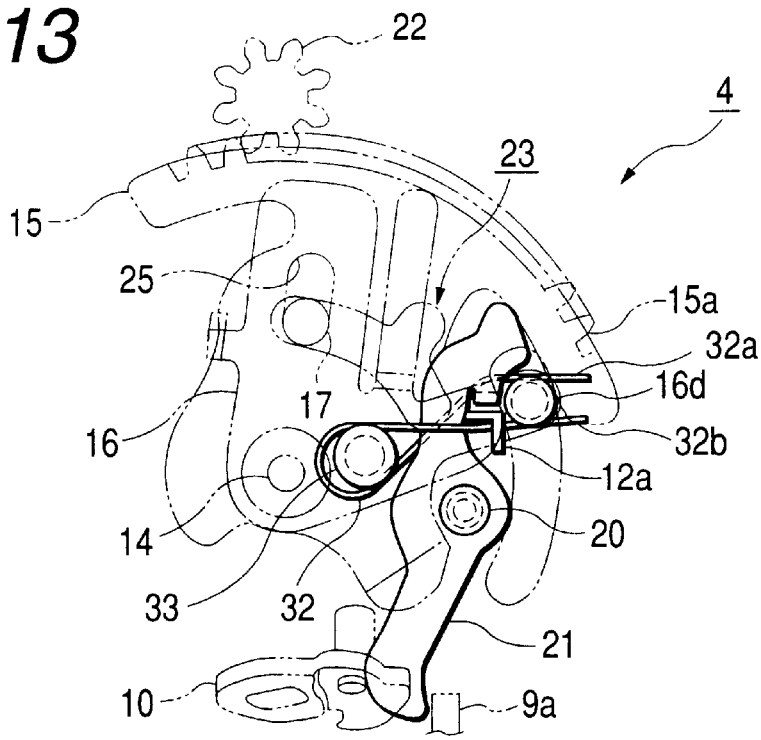
FIG. 13 is a schematic rear view of the essential part of the opening and closing device in a state where the closing action has been cancelled and the actuating lever has been returned to the neutral position.

With this operation, the actuating lever (16) is returned to the neutral position by the urging force of the helical coil spring (32) as shown in FIG. 13, and restraint of the latch (7) will be released. At the same time, by rotating the locking plate (9) in the opening direction by way of the opening arm portion **(19*b*) of the canceling lever (19) and the opening lever (21)**, the back door can be opened.

After the above described trouble has been removed, the sector gear (15) is rotated from the stop position to the neutral position by the motor (13). In the neutral position, the switching member (17) is shifted from the disconnecting state to the connecting state by the urging force of the spring (26), enabling the coupling between the sector gear (15) and the actuating lever (16) to be reinstated into the original state before the trouble has occurred.

While the sector gear (15) is rotated from the stop position to the neutral position, the actuating lever (16) is retained in the neutral position by the helical coil spring (32). Therefore, because the actuating lever (16) will not be drawn by the rotation of the sector gear (15) nor displaced from the neutral position, the switching member (17) can be reliably shifted from the disconnecting state to the connecting state.

On occasion of the above described canceling operation of the canceling lever (19), the canceling arm portion **(19*a*) is guided without a shakiness in a direction of the thickness between the support portion (16*a*) and the pressing portion (16*b*) of the actuating lever (16). Therefore, the engagement between the canceling arm portion (19*a*) and the switching member (17) will be ensured, and the switching member (17)** can be smoothly shifted from the connecting state to the disconnecting state.

After the switching member (17) has been shifted to the disconnecting state, the canceling lever (19) is returned to the waiting position by the spring (31), and the canceling arm portion **(19*a*) will be moved apart from the switching member (17). Consequently, the actuating lever (16) can be rotated smoothly and reliably to the neutral position by the helical coil spring (32)**.

According to the present invention, the following advantages can be attained.

(a) According to the invention, even in case where the rotary member has stopped at a position other than the neutral position due to a trouble in the motor or in some other components, the actuating lever can be returned to the neutral position by the urging device, by shifting the switching member from the connecting state to the disconnecting state, thus enabling the lock device to be operated.

Because the actuating lever can be retained in the neutral position by the urging device, the actuating lever will not be displaced from the neutral position by being drawn by the rotation of the rotary member which has stopped at the position other than the neutral position when it is returned to the neutral position. Therefore, the switching member staying in the disconnecting state can be reliably shifted to the connecting state.

(b) The actuating lever can be urged to the neutral position, and the opening lever can be urged to the waiting position by the single urging device, and number of the components can be decreased.

Moreover, when the actuating lever is rotated from the neutral position in such a direction that the lock device may be shifted from the half latched state to the fully latched state, the opening lever can be retained in the waiting position by the urging device. Therefore, an interference between the lock device and the opening lever will be prevented, and thus, stabilized operation can be obtained, and improvement in quality can be attained.

(c) According to the invention, even in case where the rotary member has stopped at a position other than the neutral position due to a trouble in the motor or in some other components, the switching member is moved from the connecting state to the disconnecting state by operating the canceling lever, enabling the actuating lever to be returned to the neutral position, and at the same time, the canceling arm portion of the canceling lever is moved apart from the switching member to reliably return the canceling lever to the waiting position. Therefore, a stabilized canceling operation can be obtained, and the quality can be enhanced.

(d) A shakiness of the canceling arm portion of the canceling lever is restrained by the guide device, ensuring the contact of the canceling arm portion with the switching member, and the switching member can be smoothly and reliably shifted to the disconnecting state.

(e) The shakiness of the canceling arm portion can be effectively prevented, and the contact of the canceling arm portion with the switching member can be further ensured.

In addition, it is unnecessary to apply complicated works to the base plate on which the rotary member, the actuating lever, and the canceling lever are supported, and the structure can be simplified.

(f) Since the rotary member and the actuating lever are mounted on the same shaft, the actuating device can be made compact. Moreover, the coupling between the rotary member and the actuating lever can be disconnected or connected with a simple structure, and reliable operation can be obtained.

What is claimed is:

1. An opening and closing device of a vehicle lock apparatus comprising:

a lock device actuated by a motor to be opened, and to be shifted from a half latched state to a fully latched state;

a rotary member rotatable from a neutral position in two of a normal direction and reverse direction by said motor;

an actuating lever linked to said rotary member, said actuating lever rotatable from a neutral position in an opening direction thereby to open said lock device, and being rotated in a closing direction opposite to the opening direction thereby to shift said lock device from the half latched state to the fully latched state;

an opening lever rotatable from a waiting position to an operating position by a rotation of said actuating lever in the opening direction thereby to open said lock device;

a switching member for connecting said rotary member and said actuating lever; and an urging device for urging said actuating lever to the neutral position independently of said rotary member;

wherein said switching member is configured to be shifted between a disconnecting state where said switching member disconnects a coupling between said rotary member and said actuating lever so that said actuating lever is rotated to said neutral position of said rotary member from a stopping position of said rotary member which is not said neutral position of said rotary member, and a connecting state where said rotary member in said stop position is rotated to the neutral position of said rotary member and said switching member is retained to said actuating member which is in the neutral position of said actuating member thereby to establish the coupling between said rotary member and said actuating lever.

2. An opening and closing device of a vehicle lock apparatus according to claim 1, said urging device including a helical coil spring provided with a first leg portion and a second leg portion, wherein when said actuating lever is rotated in the opening direction from the neutral position, the first leg portion of said helical coil spring is engaged with said actuating lever, while the second leg portion is engaged with a base plate on which said opening lever is pivotally mounted, thereby urging said actuating lever to the neutral position thereof, and when said actuating lever is rotated in the closing direction from the neutral position, the second leg portion of said helical coil spring is engaged with said actuating lever, while said first leg portion is engaged with said opening lever, thereby to respectively urge said actuating lever to the neutral position thereof, and said opening lever to the waiting position.

3. An opening and closing device of a vehicle lock apparatus according to claim 1, further comprising:

a switching hole formed on said rotary member, said switching hole having an arc-shaped idle portion laterally extending around a shaft pivotally supporting said rotary member, and a retaining portion radially extending from a substantially middle of said idle portion; and an elongated hole formed on said actuating lever so as to be overlapped on said switching hole;

wherein said rotary member and said actuating lever are pivotally mounted on a common shaft and said switching member is engaged in said switching hole and said elongated hole; and wherein said switching member is retained at said retaining portion when said switching member is in the connecting state, and said switching member is released from said retaining portion and slidably positioned in said idle portion when said switching member is in the disconnecting state.

4. An opening and closing device of a vehicle lock apparatus comprising:

a lock device actuated by a motor to be opened, and to be shifted from a half latched state to a fully latched state;

a rotary member rotatable from a neutral position in two of a normal direction and reverse direction by said motor;

an actuating lever linked to said rotary member, said actuating lever rotatable from a neutral position in an opening direction thereby to open said lock device, and being rotated in a closing direction opposite to the opening direction thereby to shift said lock device from the half latched state to the fully latched state;

a switching member movable in a connecting state where said rotary member and said actuating lever are coupled through said switching member and a disconnecting state where said switching member disconnects a coupling between said rotary member and said actuating lever;

an urging device for urging said switching member from the disconnecting state to the connecting state; and a canceling lever having a canceling arm portion adapted to be abutted against said switching member;

wherein said switching member is shifted from the connecting state to the disconnecting state by a rotation of said canceling lever from a waiting position to a canceling position, and said canceling arm portion is moved apart from said switching member by a rotation of said canceling lever from the canceling position to the waiting position.

5. An opening and closing device of a vehicle lock apparatus according to claim 4, further comprising:

a switching hole formed on said rotary member, said switching hole having an arc-shaped idle portion laterally extending around a shaft pivotally supporting said rotary member, and a retaining portion radially extending from a substantially middle of said idle portion; and an elongated hole formed on said actuating lever so as to be overlapped on said switching hole;

wherein said rotary member and said actuating lever are pivotally mounted on a common shaft and said switching member is slidably engaged in said switching hole and said elongated hole; and wherein said switching member is retained at said retaining portion when said switching member is in the connecting state, and said switching member is released from said retaining portion and slidably positioned in said idle portion when said switching member is in the disconnecting state.

6. An opening and closing device of a vehicle lock apparatus comprising:

a lock device actuated by a motor to be opened, and to be shifted from a half latched state to a fully latched state;

a rotary member rotatable from a neutral position in two of a normal direction and reverse direction by said motor;

an actuating lever linked to said rotary member, said actuating lever rotatable from a neutral position in an opening direction thereby to open said lock device, and being rotated in a closing direction opposite to the opening direction thereby to shift said lock device from the half latched state to the fully latched state;

a switching member movable in a connecting state where said rotary member and said actuating lever are coupled through said switching member and a disconnecting state where said switching member disconnects a coupling between said rotary member and an actuating lever;

an urging device for urging said switching member from the disconnecting state to the connecting state;

a canceling lever having a canceling arm portion adapted to be abutted against said switching member; and a guide device for guiding said canceling arm portion so as to move along a moving direction of said switching member, and so as not to move in a direction intersecting the moving direction;

wherein said switching member is shifted from the connecting state to the disconnecting state by a rotation of said canceling lever from a waiting position to a canceling position, and said switching member is moved apart from said switching member by a rotation of said canceling lever from the canceling position to the waiting position.

7. An opening and closing device of a vehicle lock apparatus according to claim 6, wherein said guide device are provided in said actuating lever.

8. An opening and closing device of a vehicle lock apparatus according to claim 6, wherein said guide device includes a support portion which is brought into a slidable contact with one side face of said canceling arm portion to support said switching member movably, and a pressing portion provided adjacent to said support portion and brought into a slidable contact with another side face of said canceling arm portion.

9. An opening and closing device of a vehicle lock apparatus according to claim 6, further comprising:

a switching hole formed on said rotary member, said switching hole having an arc-shaped idle portion laterally extending around a shaft pivotally supporting said rotary member, and a retaining portion radially extending from a substantially middle of said idle portion; and an elongated hole formed on said actuating lever so as to be overlapped on said switching hole;

wherein said rotary member and said actuating lever are pivotally mounted on a common shaft and said switching member is slidably engaged in said switching hole and said elongated hole; and wherein said switching member is retained at said retaining portion when said switching member is in the connecting state, and said switching member is released from said retaining portion and slidably positioned in said idle portion when said switching member is in the disconnecting state.

* * * * *